US005218800A

United States Patent [19]

Wakui et al.

[11] Patent Number: 5,218,800

[45] Date of Patent: Jun. 15, 1993

[54] METHOD OF INSTALLING SIDE-WALL BEAM FOR GUIDEWAY FOR MAGNETIC LEVITATION VEHICLE

[75] Inventors: Hajime Wakui; Seiichi Tottori; Nobuyuki Matsumoto; Tadatomo Watanabe, all of Tokyo; Ikuo Shimoda, Kanagawa; Shuichi Nagata, Tokyo, all of Japan

[73] Assignees: Railway Technical Research Institute; Oiles Corporation, both of Tokyo, Japan

[21] Appl. No.: 813,780

[22] Filed: Dec. 27, 1991

[51] Int. Cl.[5] ..... E01C 5/00; E04C 3/10; E04B 1/00

[52] U.S. Cl. ..... 52/223.13; 52/745.21; 404/73

[58] Field of Search ..... 52/223, 741; 404/73, 404/99; 264/35

[56] References Cited

U.S. PATENT DOCUMENTS 4,815,247 3/1989 Nicholas ..... 404/47 X

FOREIGN PATENT DOCUMENTS 3-271401 12/1991 Japan .

3-271402 12/1991 Japan .

*Primary Examiner*—Terry Lee Melius
*Assistant Examiner*—Nancy P. Connolly
*Attorney, Agent, or Firm*—Sandler, Greenblum & Bernstein

[57] ABSTRACT

A side-wall beam is installed on a base for a guideway for a magnetic levitation vehicle. An elastic body is interposed between the side-wall beam and the base. Then, the side-wall beam is fastened to the base with a tendon on an imaginary line which extends through an intermediate portion of the elastic body in the transverse direction of the side-wall beam and which extends along the longitudinal direction of the side-wall beam. The elastic body is thereby held under compression between the side-wall beam and the base. The side-wall beam is supported on the base through the elastic body, and also fastened to the base, holding the elastic body under compression between the side-wall beam and the base. Reactive forces produced by the compression of the elastic body act to resist forces tending to cause the side-wall beam to fall over. Any displacement of the side-wall beam which may be caused by forces generated when the magnetic levitation vehicle passes can thereby be kept within a predetermined range.

18 Claims, 11 Drawing Sheets

METHOD OF INSTALLING SIDE-WALL BEAM FOR GUIDEWAY FOR MAGNETIC LEVITATION VEHICLE

BACKGROUND OF THE INVENTION

Field of the Invention

The present invention relates to a guideway for a magnetic levitation vehicle of the side-wall levitated system, and more particularly to a method of installing a side-wall beam of a guideway for a magnetic levitation vehicle.

Description of the Related Art

Side-wall levitated systems have been developed in recent years as systems for levitating, guiding, and propelling magnetic levitation vehicles. Typically, a side-wall levitated system includes side-wall beams on which levitating and guiding coils and propelling coils are mounted for applying levitating, guiding, and propelling forces from the side-wall beams to the magnetic levitation vehicle. The side-wall levitated system offers many design advantages as it allows the various coils to be high in efficiency, and it is relatively simple in structure.

According to one side-wall levitated system, side-wall beams are manufactured as precast concrete units in a factory, and installed on a base at the construction site. Such an installation process is attracting much attention since a high degree of installation accuracy is achieved by a simple installing operation, and settlements induced by aging can be made up for by a simple readjusting operation.

In the side-wall levitated systems, when a magnetic levitation system passes, the side-wall beams are subject to reactive forces for bearing the weight of the magnetic levitation vehicle, reactive forces for guiding the magnetic levitation vehicle, and impact forces applied by the magnetic levitation vehicle. These forces act as moments tending to turn the side-wall beams over in the transverse direction thereof.

When the side-wall beams undergo such moments, it is necessary to minimize any displacement of the side-wall beams in order to prevent the cars of the magnetic levitation vehicle from being unduly vibrated.

Typically, the side-wall beams are about 12 m long. Therefore, longitudinal expansion and contraction of the side-wall beams, due to temperature changes, should be taken into consideration.

The impact forces tending to be imposed on the side-wall beams should be dampened to the extent that any displacement of the side-wall beams caused by the impact forces will be kept in a predetermined range of about a few millimeters.

There are known guideways for magnetic levitation systems. The guideways are composed of bases and side-wall beams that are separate from each other, with the side-wall beams being installed on the bases at the construction site. With such guideways, the reduction of any displacement of the side-wall beams when the magnetic levitation system passes, may be reduced.

SUMMARY OF THE INVENTION

It is an object of the present invention to provide a method of installing a side-wall beam for a guideway for a magnetic levitation vehicle, while keeping any displacement of the side-wall beam within a predetermined range.

According to the present invention, there is provided a method of installing a side-wall beam on a base for a guideway for a magnetic levitation vehicle. The side-wall beam having has a length along a longitudinal direction thereof in which the magnetic levitation vehicle runs, and a width along a transverse direction thereof perpendicular to the longitudinal direction. The method comprises the steps of interposing an elastic body between the side-wall beam and the base, and fastening the side-wall beam to the base on an imaginary line which extends through an intermediate portion of the elastic body in the transverse direction of the side-wall beam and which extends along the longitudinal direction of the side-wall beam. This enable the holding of the elastic body under compression between the side-wall beam and the base.

The side-wall beam is supported on the base through the elastic body, and is also fastened to the base, holding the elastic body under compression between the side-wall beam and the base. Reactive forces produced by the compression of the elastic body act to resist forces tending to cause the side-wall beam to fall over. Any displacement of the side-wall beam, which may be caused by forces generated when the magnetic levitation vehicle passes, can thereby be kept within a predetermined range.

According to the present invention, there is also provided a method of installing a side-wall beam on a base for a guideway for a magnetic levitation vehicle. The side-wall beam has a length along a longitudinal direction thereof in which the magnetic levitation vehicle runs, and a width along a transverse direction thereof perpendicular to the longitudinal direction. The method comprises the steps of interposing a plurality of elastic bodies between the side-wall beam and the base at spaced intervals in the longitudinal direction of the side-wall beam. This provides a plurality of tendons having a predetermined length for fastening the side-wall beam to the base a plurality of vertical holes are defined through the side-wall beam at spaced intervals in the longitudinal direction thereof on an imaginary line which extends through an intermediate portion of each of the elastic bodies in the transverse direction of the side-wall beam and which extends along the longitudinal direction of the side-wall beam. The vertical holes have a cross-sectional area larger than the cross-sectional area of the tendons. The tendons are inserted through the holes, respectively, fixing lower ends of the tendons to the base, fixing upper ends of the tendons to an upper end of the side-wall beam, and pretensioning the tendons to fasten the side-wall beam to the base, thereby holding the elastic bodies under compression between the side-wall beam and the base.

If the side-wall beam is expanded or contracted in its longitudinal direction due to a temperature change, the elastic bodies are elastically deformed to compensate for the deformation of the side-wall beam. Therefore, the side-wall beam can stably be held in position in the event of changes in the ambient temperature.

Furthermore, an energy absorber is interposed between the side-wall beam and the base. When shocks or impacts are applied to the side-wall beam, they are absorbed by the energy absorber, and any shock-induced displacement of the side-wall beam is held within a predetermined range.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
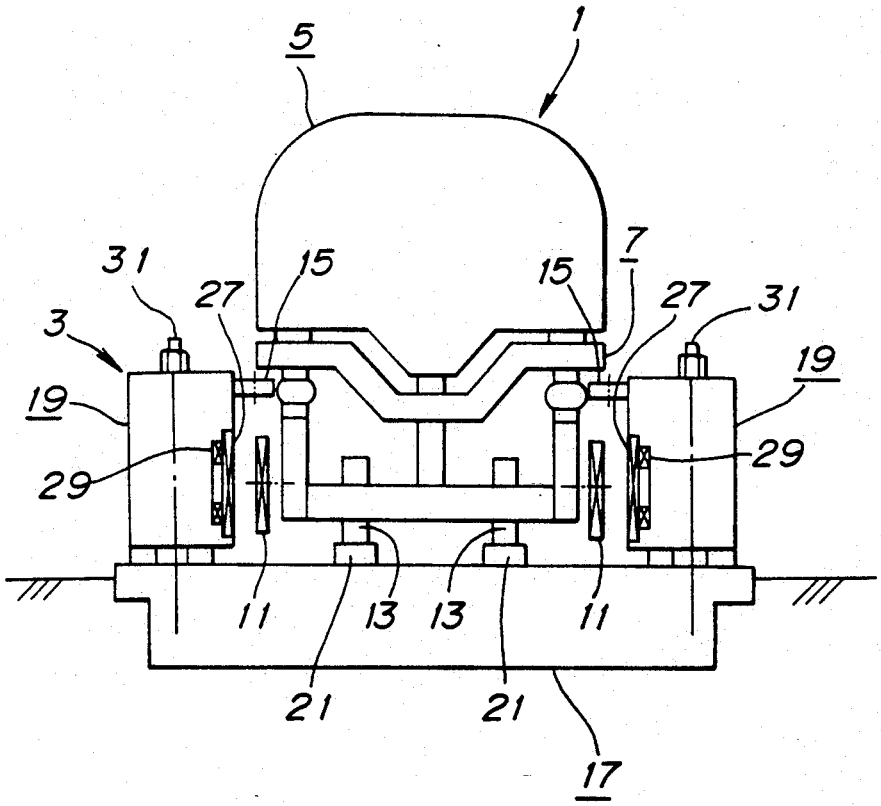
FIG. 1 is a sectional front elevational view of a guideway, including side-wall beams installed by a method according to a first embodiment of the present invention.

Like or corresponding parts are denoted by like or corresponding reference characters throughout the views.

Figure 2:
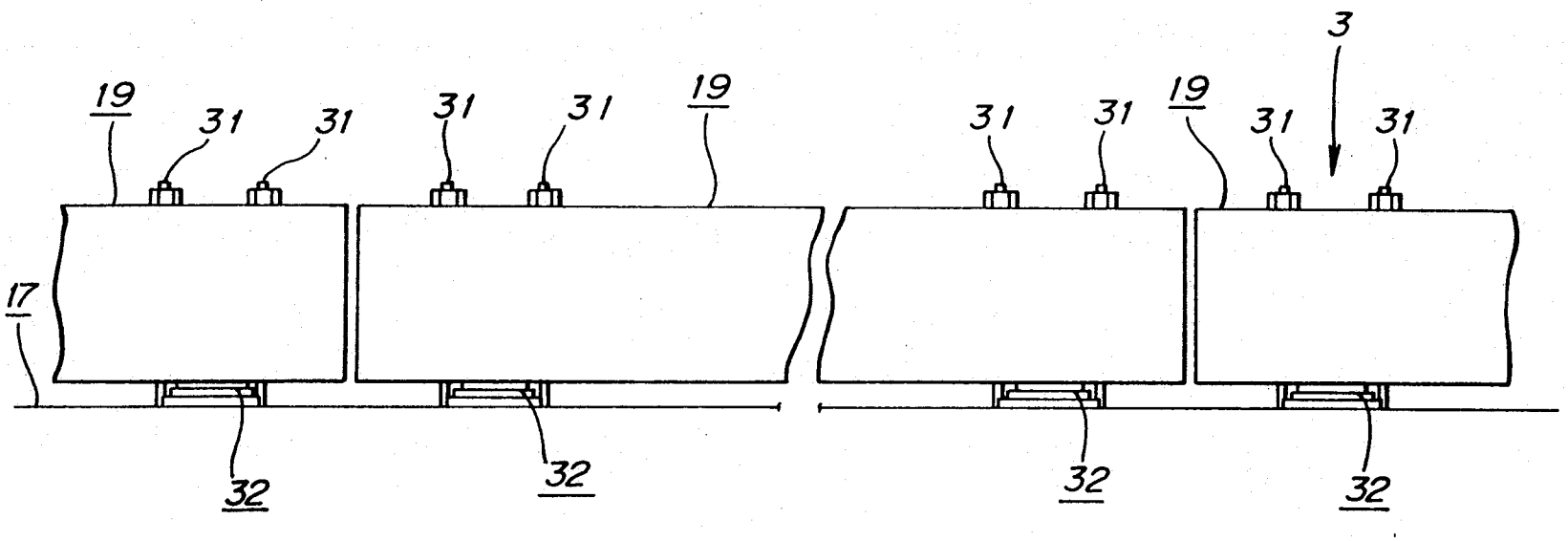
FIG. 2 is a fragmentary side elevational view of the guideway, as shown in FIG. 1.

FIG. 1 shows a guideway in cross section, and FIG. 2 shows the guideway in fragmentary side elevation.

As shown in FIGS. 1 and 2, a magnetic levitation system 1 is levitated, guided, and propelled by a guideway 3.

The magnetic levitation system 1 comprises a car frame 5 and a carriage frame 7, which are operatively coupled to each other by links and springs. The magnetic levitation system 1 also includes superconductive magnets 11 mounted on opposite outer sides of the carriage frame 7. The carriage frame 7 supports thereon rubber support wheels 13 and guide wheels 15 which are brought into operation, when the magnetic levitation system 1 is stopped or running at low speed.

The guideway 3 comprises a base 17 and side-wall beams 19 mounted vertically on opposite marginal edges of the base 17.

Each of the side-wall beams 19 has a length along its longitudinal direction in which the magnetic levitation system 1 runs, and a width along its transverse direction perpendicular to the longitudinal direction thereof, i.e., the running direction of the magnetic levitation system 1. The side-wall beams 19 have flat low surfaces. The side-wall beams 19 are manufactured as precast concrete units in a factory, and installed on the base 17 at the construction site.

The base 17 has a flat upper surface lying in a horizontal plane, and supports on its central upper surface, rails or tracks 21 of concrete for supporting the wheels 13 thereon.

Figure 3:
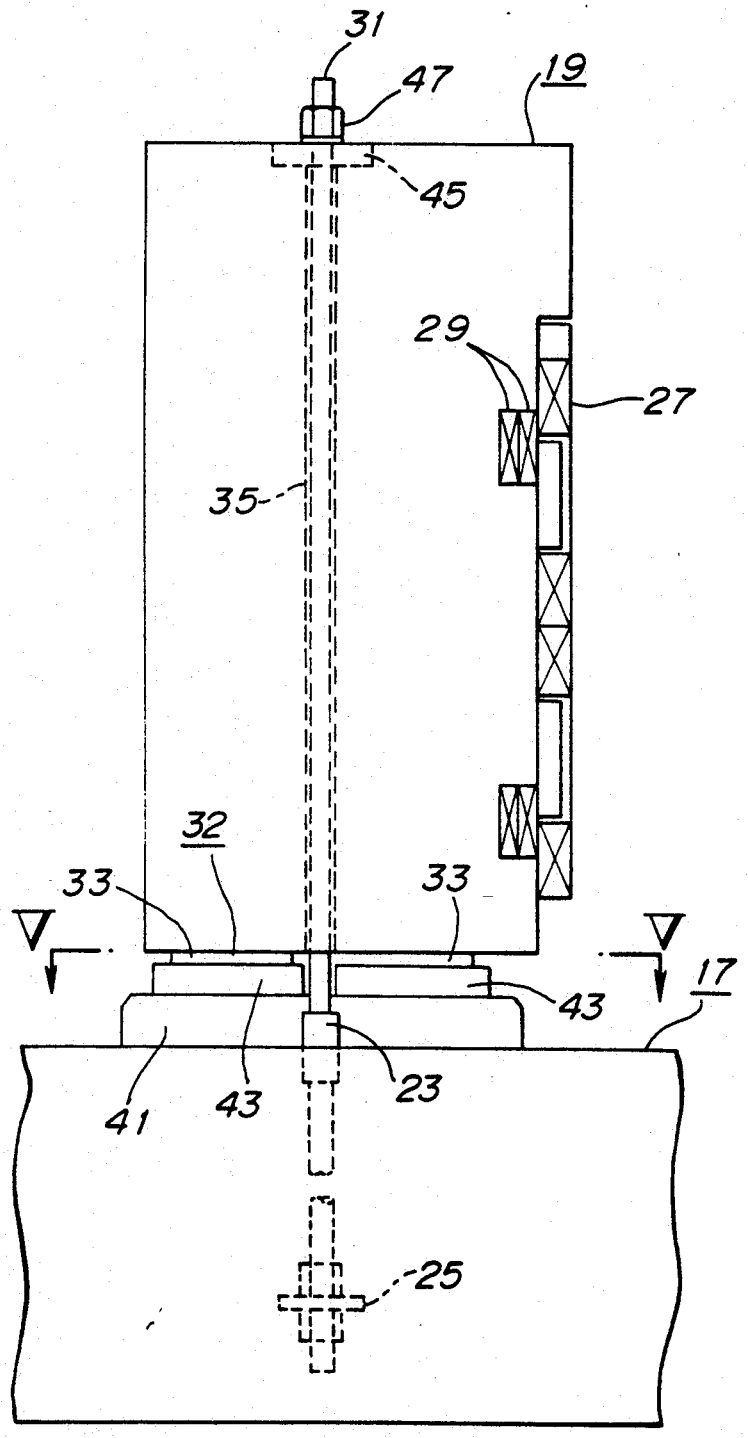
FIG. 3 is an enlarged fragmentary front elevational view showing an installation structure for a side-wall beam of the guideway, as shown in FIG. 1.
Figure 4:
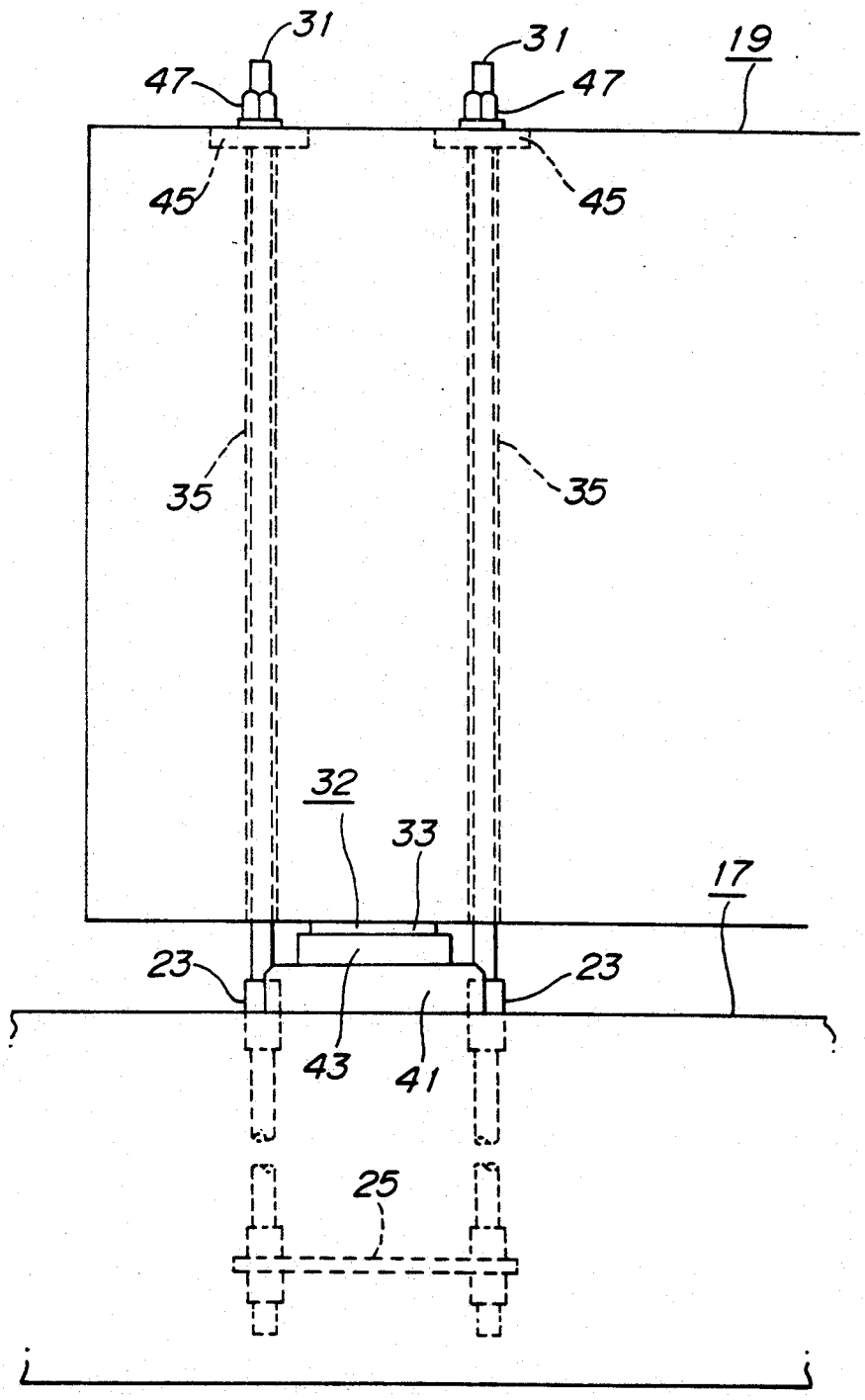
FIG. 4 is an enlarged fragmentary side elevational view of the installation structure shown in FIG. 3.

As shown in FIGS. 3 and 4, joints 23 are partly embedded in the longitudinal, opposite marginal edges of the base 17, and coupled to anchor plates 25 in the base 17.

Figure 8:
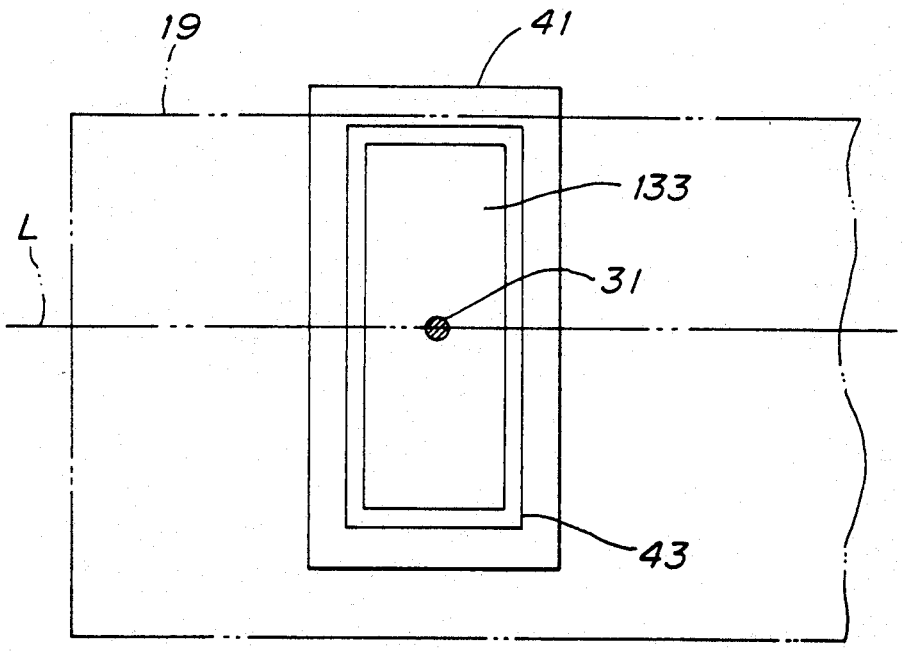
FIG. 8 is a plan view of a modified elastic member for the guideway, as shown in FIG. 1.

Figure 8-shaped levitating and guiding coils 27 are mounted on confronting side surfaces of the side-wall beams 19 in confronting relationship to the superconductive magnets 11. The coils 27 are successively arranged in the longitudinal direction of the side-wall beams 19. Elliptical propelling coils 29 are also mounted on the confronting side surfaces of the side-wall beams 19, outside of the levitating and guiding coils 27. The propelling coils 29 are superposed on the levitating and guiding coils 27 in the transverse direction of the side-wall beams 19.

The side-wall beams 19 are fastened to the base 17 by tendons 31 at longitudinally spaced intervals. Elastic bodies 32 are interposed under compression between the side-wall beams 19 and the base 17 at longitudinally spaced intervals.

Figure 5:
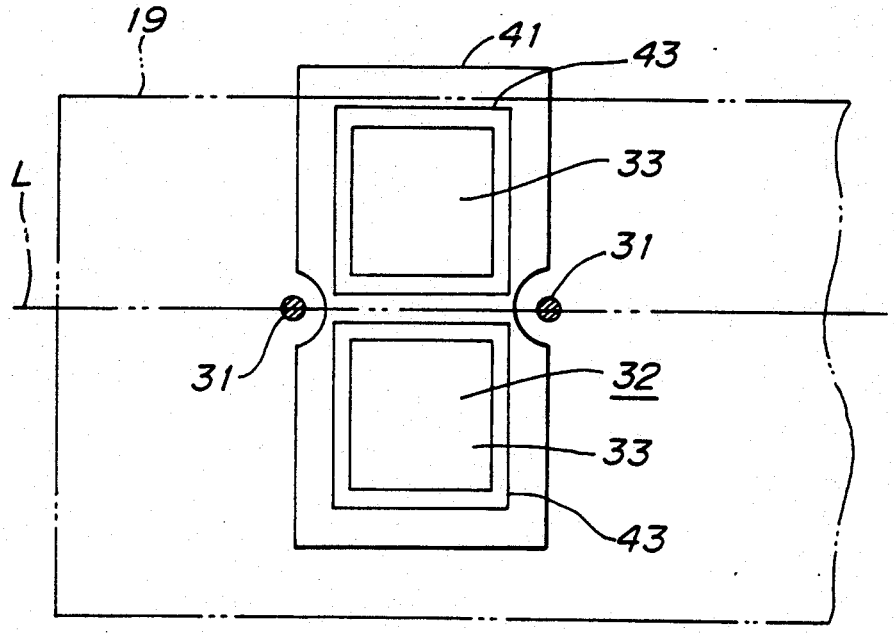
FIG. 5 is a cross-sectional view taken along line V—V of FIG. 3.

As also shown in FIGS. 3 through 5, each of the elastic bodies 32 is positioned near a longitudinal end of each of the side-wall beams 19. Each elastic body 32 comprises two inner and outer elastic members 33 spaced from each other in the transverse direction of the side-wall beam 19.

The tendons 31, that fasten the side-wall beams 19 to the base 17, extend vertically on an imaginary line L (see FIG. 5) which passes through an intermediate portion of the elastic bodies 32 in the transverse direction of the side-wall beams 19, and which extend in the longitudinal direction of the side-wall beams 19. The elastic bodies 32 are thus held under compression between the side-wall beams 19 and the base 17. As shown in FIG. 5, the imaginary line L extends centrally between the two elastic members 33, of each elastic body 32, in the longitudinal direction of the side-wall beams 19.

Each of the tendons 31 is inserted through a vertical through hole 35 defined in the side-wall beam 19. The hole 35 has a diameter or a cross-sectional area slightly greater than the diameter or the cross-sectional area of the tendon 31 which is inserted therethrough, so that a clearance or gap is created between the surface of the hole 35 and the tendon 31.

Figure 6:
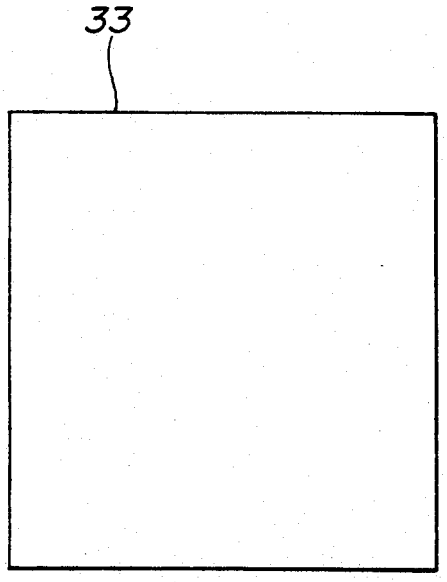
FIG. 6 is a plan view of an elastic member in the installation structure shown in FIG. 3.
Figure 7:
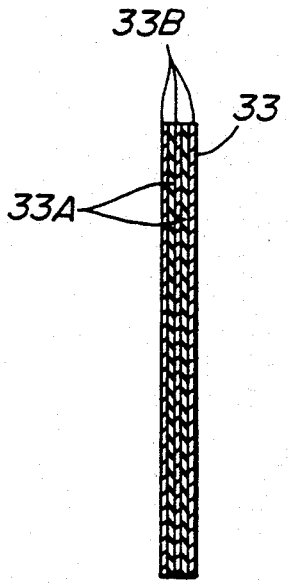
FIG. 7 is a cross-sectional view of the elastic member shown in FIG. 6.

As shown in FIGS. 6 and 7, each of the elastic members 33 is of a laminated structure composed of thin rubber sheets 33A and rigid nonmagnetic thin sheets 33B of stainless steel, which alternate with the rubber sheets 33A. The elastic member 33 is of a flat configuration having flat upper and lower end surfaces, and has a substantially square shape as viewed in a front elevation.

As shown in FIGS. 3 and 4, each of the elastic members 32 is placed on a combination of formed from a seat 41 of mortar positioned on the base 17 and a planar shim plate 43 positioned on the seat 41 for height adjustment. The seat 41 and the shim plate 43 are made of a nonmagnetic material. The seat 41 is of an elongate rectangular shape, and the shim plate 43 is of a substantially square shape.

Each side-wall beam 19 is installed on the base 17 as follows: First, the elastic members 33 are placed on the shim plate 43 on the seat 41 on the base 17, and then the side-wall beam 19 is positioned on the elastic members 33.

Then, the tendons 31 are inserted through the holes 35, and the lower ends thereof are threaded in the joints 23. The tendons 31 have upper ends projecting from the side-wall beam 19. Nuts 47 are threaded over the projecting upper ends of the tendons 31 on respective anchor plates 45 that are embedded in an upper surface of the side-wall beam 19, thus pretensioning the tendons 31. The nuts 47 and the tendons 31 compress the elastic members 33 and fasten the side-wall beam 19 to the base 17.

In the above embodiment, the weight of the side-wall beam 19 acting on the two elastic members 33 of each elastic body 32 was 5 t, and the side-wall beam 19 was fastened to the base 17 under the force of 20 t.

Since the side-wall beam 19 is fastened to the base 17 by the tendons 31, the two elastic members 33 of each elastic body 32 are compressed, and reactive forces produced by the compression of each of the elastic members 33 always act as moments on the side-wall-beam 19 in transversely outward and inward direction about the imaginary line L. Under such applied moments, the side-wall beam 19 is installed on the base 17 while resisting forces tending to cause the side-wall beam 19 to fall over.

Moments are produced under reactive forces in opposition to levitating forces and guiding forces created upon the passage of the magnetic levitation vehicle 1. These reactive forces are exerted to the side-wall beam 19 outwardly in the transverse direction thereof. The outer elastic member 33 is compressed, producing reactive forces that act transversely inward as a moment about the imaginary line L. When moments produced under reactive forces in opposition to levitating forces and guiding forces are exerted to the side-wall beam 19 inwardly in the transverse direction thereof, reactive forces, produced by the compression of the inner elastic member 33, act transversely outward as a moment about the imaginary line L. Accordingly, any displacement of the side-wall beam 19, which takes place when the magnetic levitation vehicle 1 passes, can be kept within a predetermined range.

If the side-wall beam 19 is expanded or contracted in its longitudinal direction due to a temperature change, the elastic members 33 are elastically deformed to compensate for the deformation of the side-wall beam 19. Therefore, the side-wall beam 19 can stably be held in position in the event of changes in the ambient temperature. Inasmuch as the tendons 31 are loosely inserted through the holes 35 with a clearance or gap left therebetween, and the tendons 31 are long, the tendons 31 can easily follow an expansion or contraction of the side-wall beam 19, thus compensating for such deformation of the side-wall beam 19.

In the above embodiment, the tendons 31 are positioned one on each side of the elastic members 33 of each elastic body 32 in the longitudinal direction of the side-wall beam 19. However, the tendons 31 may extend through the elastic members 33.

While each of the elastic bodies 32 is composed of two elastic members 33 in the above embodiment, the elastic body 32 may comprise three or more elastic members. The elastic members 33 may be of a rectangular, circular, annular, or any other cross-sectional shape.

Moreover, as shown in FIG. 8, an elastic body may comprise a single elastic member 133 having a length in the transverse direction of the side-wall beam 19. In such a modification, the tendons 31 may be disposed one on each side of the elastic member 133, or the single tendon 31 may extend through the elastic member 133, as shown in FIG. 8.

A second embodiment of the present invention will now be described below.

Figure 9:
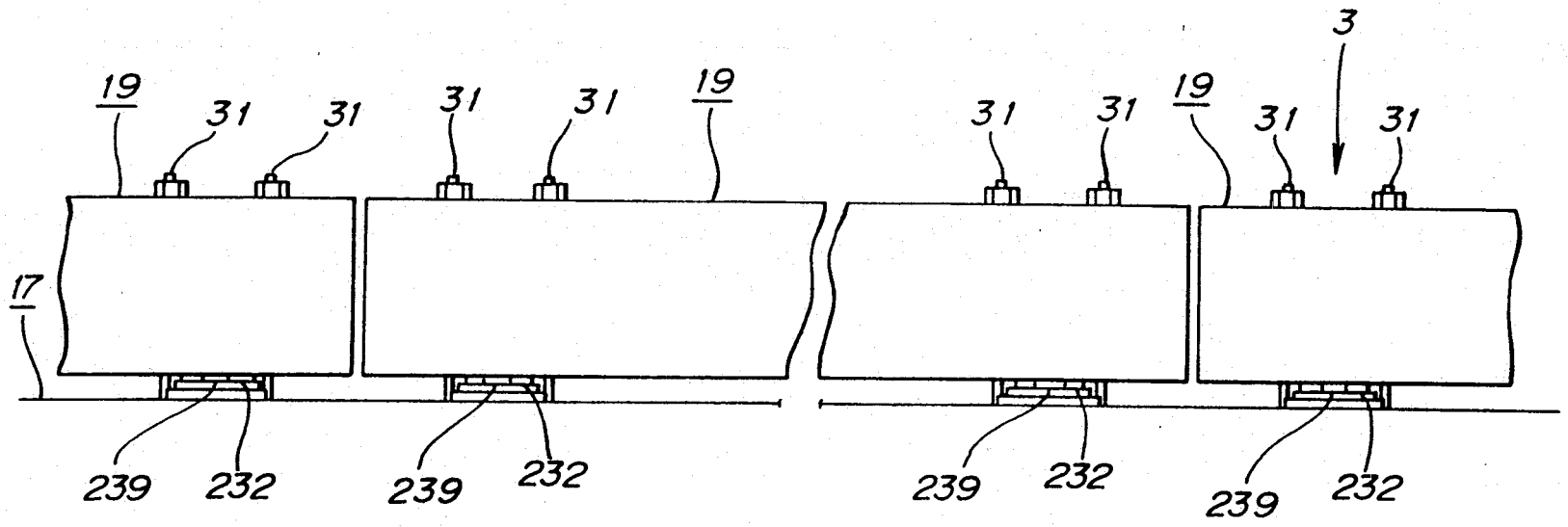
FIG. 9 is a fragmentary side elevational view of a guideway, including side-wall beams installed by a method according to second embodiment of the present invention.
Figure 10:
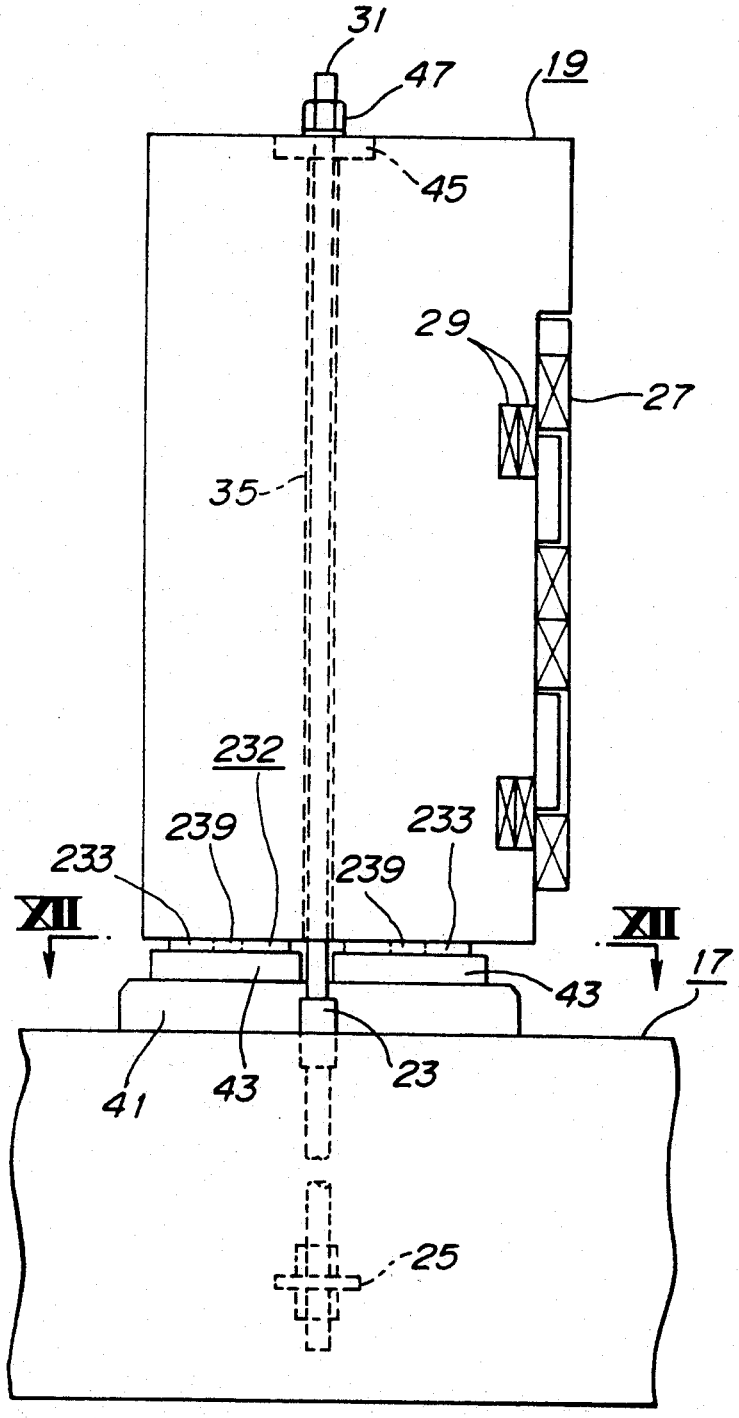
FIG. 10 is an enlarged fragmentary front elevational view showing an installation structure for a side-wall beam of the guideway, as shown in FIG. 9.
Figure 11:
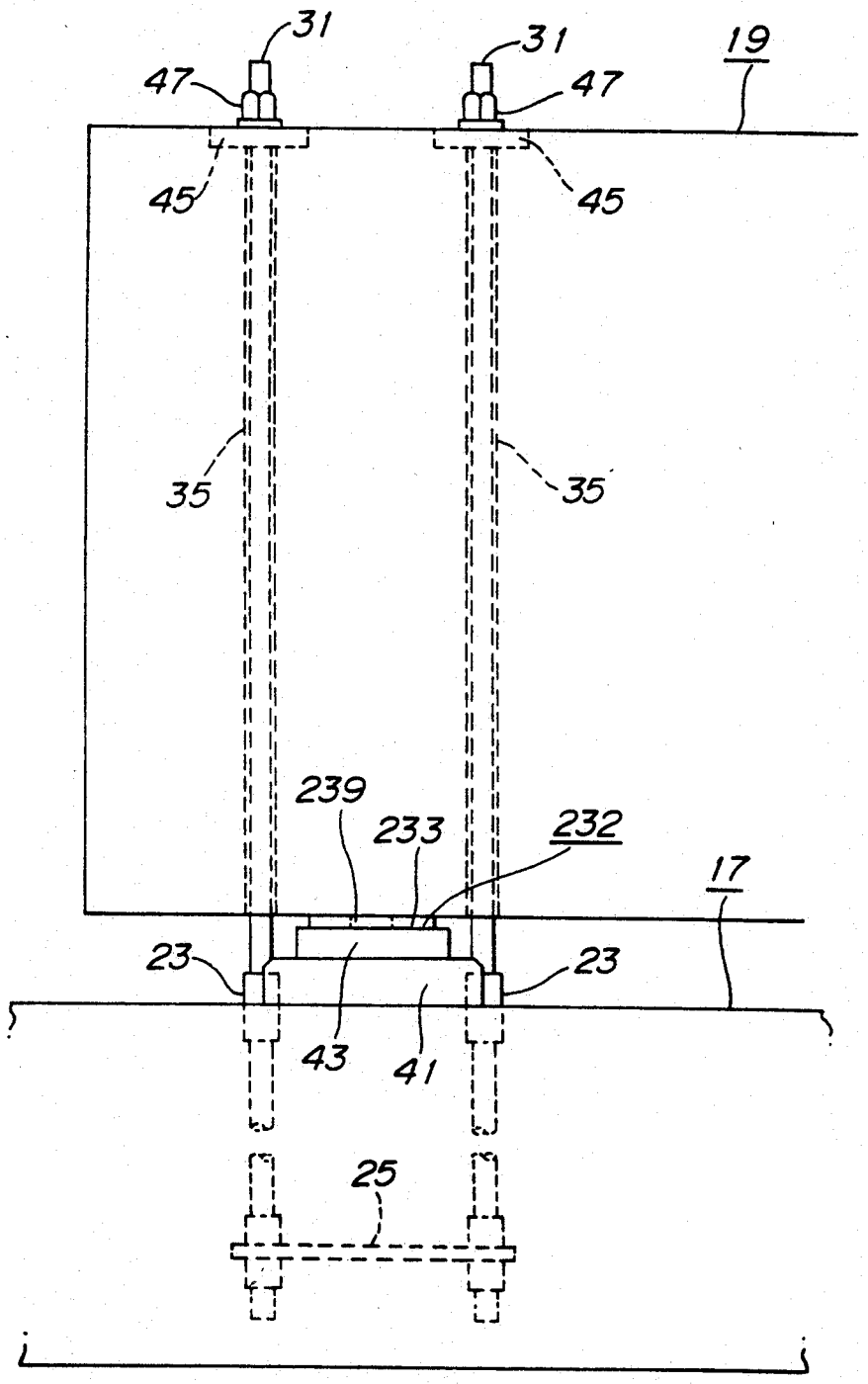
FIG. 11 is an enlarged fragmentary side elevational view of the installation structure shown in FIG. 9.

As shown in FIGS. 9 through 11, the second embodiment differs from the first embodiment in that energy absorbers 239 are interposed, in addition to elastic bodies 232, between side-wall beams 19 and a base 17.

As with the first embodiment, a guideway 3 comprises a base 17 and side-wall beams 19 mounted vertically on opposite marginal edges of the base 17. As shown in FIGS. 10 and 11, joints 23 are partly embedded in the longitudinal opposite marginal edges of the base 17, and coupled to anchor plates 25 in the base 17.

Each of the side-wall beams 19, with levitating and guiding coils 27 and propelling coils 29 attached thereto, is installed on the base 17 by two tendons 31, an elastic body 232, and two energy absorbers 239 at each of the longitudinal ends of the side-wall beam 19.

Figure 12:
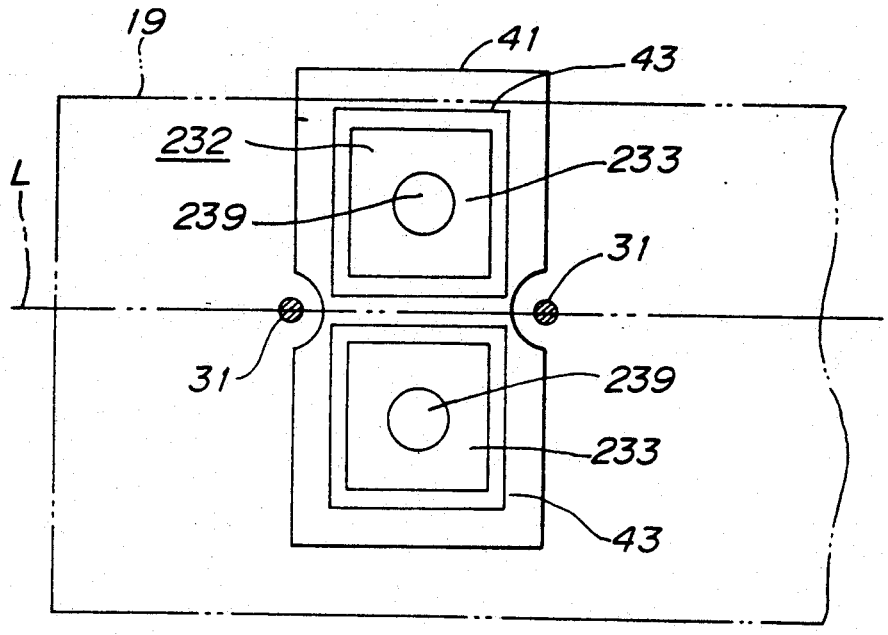
FIG. 12 is a cross-sectional view taken along line XII—XII of FIG. 10.

As shown in FIG. 12, the elastic body 232 comprises two inner and outer elastic members 233 spaced from each other in the transverse direction of the side-wall beam 19.

The side-wall beams 19 are fastened to the base 17 by the tendons 19 that extend vertically on an imaginary line L (see FIG. 12), which passes centrally between the elastic members 233, and which extend in the longitudinal direction of the side-wall beams 19. The elastic members 233 are thus held under compression between the side-wall beams 19 and the base 17.

Figure 13:
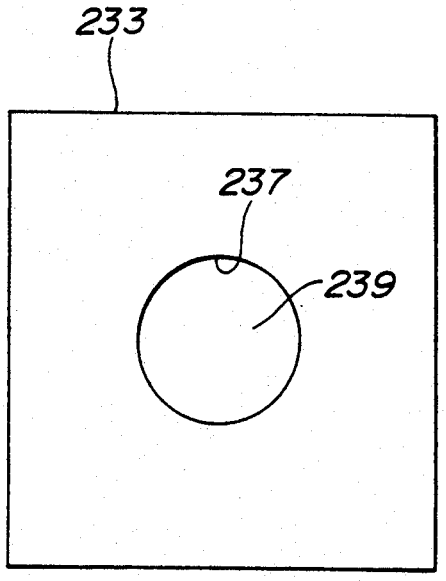
FIG. 13 is a plan view of an elastic member in the installation structure shown in FIG. 10.
Figure 14:
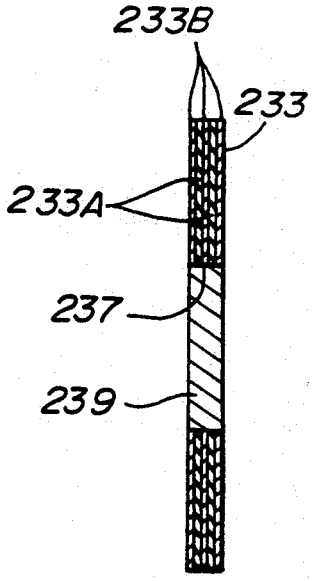
FIG. 14 is a cross-sectional view of the elastic member shown in FIG. 13.

As shown in FIGS. 13 and 14, each of the elastic members 233 is of a laminated structure composed of thin rubber sheets 233A and rigid nonmagnetic thin sheets 233B of stainless steel which alternate with the rubber sheets 233A. The elastic member 233 has a substantially square shape as viewed in front elevation, with a central circular hole 237 defined therein.

Each of the energy absorbers 239 is inserted in the central hole 237 of one of the elastic members 233. In this embodiment, each energy absorber 239 comprises a solid cylinder of lead. However, each energy absorber 239 may comprise a solid cylinder of high damping rubber or a visco-elastic material, or a granular body of nonmagnetic stainless beads or glass beads.

Each side-wall beam 19 is installed on the base 17 as follows: First, the elastic members 233 with the energy absorbers 239 assembled therein are placed on the shim plate 43 on the seat 41 on the base 17, and then the side-wall beam 19 is put on the elastic members 233.

Then, the tendons 31 are inserted through the holes 35, and the lower ends thereof are threaded in the joints 23. Nuts 47 are threaded over the upper ends of the tendons 31 on respective anchor plates 45 that are embedded in an upper surface of the side-wall beam 19, thus pretensioning the tendons 31. The nuts 47 and the tendons 31 compress the elastic members 33 and fasten the side-wall beam 19 to the base 17.

In the second embodiment, the weight of the side-wall beam 19 acting on the two elastic members 233 of each elastic body 232 was 5 t, and the side-wall beam 19 was fastened to the base 17 under the force of 20 t.

As with the first embodiment, the side-wall beams 19 are prevented from falling over by reactive forces produced by the compression of the elastic members 233. Accordingly, any displacement of the side-wall beam 19 which occurs when the magnetic levitation vehicle 1 passes can be kept within a predetermined range.

If the side-wall beam 19 is expanded or contracted in its longitudinal direction due to a temperature change, the elastic members 233 are elastically deformed to compensate for the deformation of the side-wall beam 19. Therefore, the side-wall beam 19 can stably be held in position in the event of changes in the ambient temperature.

The energy absorbers 239 interposed between the side-wall beams 19 and the base 17 are effective to absorb impacts or shocks that are applied to the side-wall beams 19, thereby keeping the shock-induced displacement of the side-wall beams 19 within a predetermined range.

Since each of the energy absorbers 239 is made of lead in the second embodiment, it exhibits rheologic characteristics to allow a gradual expansion or contraction of the side-wall beams 19 upon a temperature change, and performs an elastic-plastic function to quickly absorb abrupt shocks or impacts imposed on the side-wall beams 19.

Inasmuch as the energy absorbers 239 of lead are vertically disposed in the elastic members 233, the energy absorbers 239 are not required to be installed separately from the elastic members 233. Consequently, the elastic members 233 and the energy absorbers 239 can easily be installed on the base 17.

The energy absorbers 239 of lead are tightly filled in the elastic members 233 by fastening forces exerted by the tendons 31, and are confined circumferentially by the elastic members 233. Therefore, the energy absorbers 239 are well capable of absorbing energies, and are highly durable in use.

Figure 15:
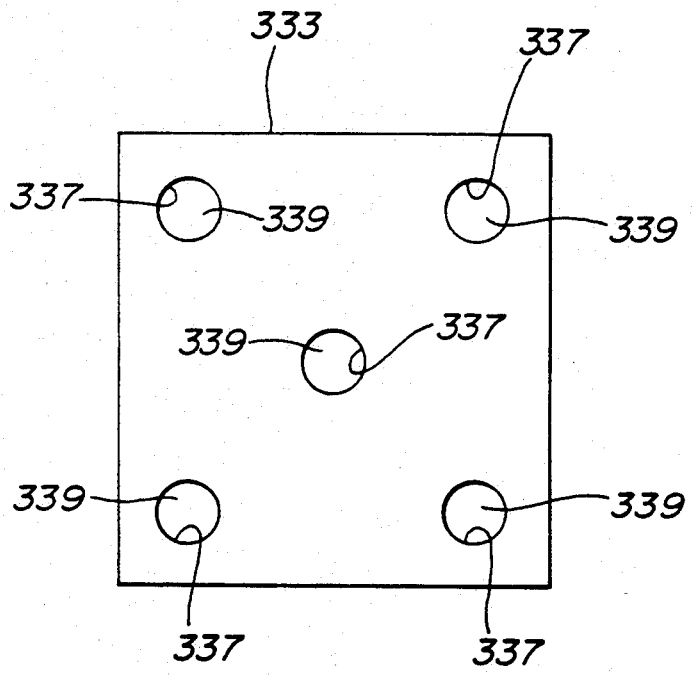
FIG. 15 is a plan view of a modified elastic member for the guideway, as shown in FIG. 9.

FIG. 15 shows a modified elastic member of the second embodiment.

The modified elastic member, denoted at 333, has five circular holes 337 each filled with a cylinder 339 of lead for absorbing applied shocks.

While the energy absorbers are disposed within the elastic members in the second embodiment, the energy absorbers may be provided separately from the elastic members.

The number of elastic members and energy absorbers used may be selected as desired. The elastic members and the energy absorbers may be of any desired cross-sectional shape such as a rectangular, circular, or annular shape.

Although certain preferred embodiments of the present invention have been shown and described in detail, it should be understood that various changes and modifications may be made therein without departing from the scope of the appended claims.

What is claimed is:

1. A method of installing a side-wall beam on a base for a guideway for a magnetic levitation vehicle, the side-wall beam having a length along a longitudinal direction thereof in which the magnetic levitation vehicle runs and a width along a transverse direction thereof perpendicular to said longitudinal direction, said method comprising the steps of:

interposing an elastic body between the side-wall beam and the base; and fastening the side-wall beam to the base on an imaginary line which extends through an intermediate portion of said elastic body in the transverse direction of the side-wall beam and which extends along the longitudinal direction of the side-wall beam, thereby holding said elastic body under compression between the side-wall beam and the base.

2. A method according to claim 1, further comprising the step of interposing a plurality of elastic bodies between the side-wall beam and the base at spaced intervals in the longitudinal direction of the side-wall beam.

3. A method according to claim 1, wherein said elastic body comprises two elastic members spaced from each other in the transverse direction of the side-wall beam, further including the step of fastening the side-wall beam to the base with a tendon which extends vertically between said elastic members.

4. A method according to claim 1, wherein said elastic body comprises a single elastic member, further including the step of fastening the side-wall beam to the base with a tendon which extends vertically through said elastic member.

5. A method according to claim 1, wherein said elastic body comprises at least one elastic member, said elastic member comprising a plurality of thin rubber plates and a plurality of rigid nonmagnetic thin plates alternating with said thin rubber plates.

6. A method according to claim 1, further including the step of fastening the side-wall beam to the base with a tendon having a predetermined length, said side-wall beam having a vertical hole defined therethrough and having a cross-sectional area larger than the cross-sectional area of said tendon, said tendon extending through said vertical hole in the side-wall beam, said tendon having a lower end coupled to the base and an upper end projecting from the side-wall beam and coupled thereto by a nut threaded over the upper end of the tendon.

7. A method according to claim 1, further including the step of interposing an energy absorber between said side-wall beam and said base.

8. A method according to claim 7, further comprising the step of interposing two energy absorbers spaced from each other in the transverse direction of the side-wall beam and disposed one on each side of said imaginary line.

9. A method according to claim 7, wherein said energy absorber is made of lead.

10. A method according to claim 9, wherein said elastic body has a vertical hole defined therethrough, said energy absorber being tightly filled in a space defined by said hole, said side-wall beam, and said base.

11. A method of installing a side-wall beam on a base for a guideway for a magnetic levitation vehicle, the side-wall beam having a length along a longitudinal direction thereof in which the magnetic levitation vehicle runs and a width along a transverse direction thereof perpendicular to said longitudinal direction, said method comprising the steps of:

interposing a plurality of elastic bodies between the side-wall beam and the base at spaced intervals in the longitudinal direction of the side-wall beam;

providing a plurality of tendons having a predetermined length for fastening the side-wall beam to the base;

defining a plurality of vertical holes through the side-wall beam at spaced intervals in the longitudinal direction thereof on an imaginary line which extends through an intermediate portion of each of said elastic bodies in the transverse direction of the side-wall beam and which extends along the longitudinal direction of the side-wall beam, said vertical holes having a cross-sectional area larger than the cross-sectional area of said tendons;

inserting said tendons through said holes, respectively;

fixing lower ends of said tendons to the base;

fixing upper ends of said tendons to an upper end of the side-wall beam; and pretensioning said tendons to fasten the side-wall beam to the base, thereby holding said elastic bodies under compression between the side-wall beam and the base.

12. A method according to claim 11, wherein said elastic body comprises two elastic members spaced from each other in the transverse direction of the side-wall beam, each of said tendons being positioned between said elastic members.

13. A method according to claim 11, wherein said elastic body comprises a single elastic member, each of said tendons extending through said elastic member.

14. A method according to claim 11, wherein said elastic body comprises at least one elastic member, said elastic member comprising a plurality of thin rubber plates and a plurality of rigid nonmagnetic thin plates alternating with said thin rubber plates.

15. A method according to claim 11, further including the step of interposing an energy absorber between said side-wall beam and said base.

16. A method according to claim 15, further comprising the step of interposing two energy absorbers spaced from each other in the transverse direction of the side-wall beam and disposed one on each side of said imaginary line.

17. A method according to claim 15, wherein said energy absorber is made of lead.

18. A method according to claim 17, wherein said elastic body has a vertical hole defined therethrough, said energy absorber being tightly filled in a space defined by said hole, said side-wall beam, and said base.

* * * * *